US007245082B1

(12) United States Patent
Fleming

(10) Patent No.: US 7,245,082 B1
(45) Date of Patent: Jul. 17, 2007

(54) MODE SEEDING CATHODE FOR A RELATIVISTIC MAGNETRON

(75) Inventor: Timothy P. Fleming, Edgewood, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 253 days.

(21) Appl. No.: 11/146,976

(22) Filed: Jun. 6, 2005

(51) Int. Cl.
*H01J 25/50* (2006.01)
*H01J 23/05* (2006.01)

(52) U.S. Cl. ..... 315/39.67; 315/39.75; 331/87

(58) Field of Classification Search ..... 315/39.51, 315/39.63, 39.65, 39.67; 331/86, 87, 89
See application file for complete search history.

(56) References Cited

U.S. PATENT DOCUMENTS 2,808,568 A * 10/1957 Cuccia ..... 332/166
6,005,347 A * 12/1999 Lee ..... 315/39.63
7,106,004 B1 * 9/2006 Greenwood ..... 315/39.51

OTHER PUBLICATIONS

M. C. Jones, V. B. Neculaes, Y. Y. Lau, R. M. Gilgenbach and W. M. White, "Cathode priming of a relativistic magnetron," Appl. Phys. Lett. 85, pp. 6332-6334, Dec. 2004.

M. C. Jones, V. B. Neculaes, W. M. White, Y. Y. Lau, R. M. Gilgenbach, J. W. Luginsland, P. Pengvanich, N. M. Jordan, Y. Hidaka, and H. L. Bosman, "Simulations of magnetic priming in a relativistic magnetron," IEEE Trans. on Elec. Devices, 52, pp. 858-863, May 2005.

* cited by examiner

*Primary Examiner*—Benny T. Lee
(74) *Attorney, Agent, or Firm*—Kenneth E. Callahan

(57) ABSTRACT

A high-power relativistic magnetron wherein the cathode geometry is shaped to form a DC electric field that has a non-negligible azimuthal component causing preferential selection of the pi mode at startup (suppression of mode competition), a significant increase in radiated power output and time integrated efficiency when compared to standard relativistic magnetron cathode designs.

1 Claim, 12 Drawing Sheets

MODE SEEDING CATHODE FOR A RELATIVISTIC MAGNETRON

STATEMENT OF GOVERNMENT INTEREST

The conditions under which this invention was made are such as to entitle the Government of the United States under paragraph I(a) of Executive Order 10096, as represented by the Secretary of the Air Force, to the entire right, title and interest therein, including foreign rights.

BACKGROUND OF THE INVENTION

High power relativistic magnetrons are devices that emit microwave radiation in short pulses. These devices are plagued by several problems. Because these devices operate in a pulse mode and the pulse lasts only a few hundred nanoseconds, any reduction in the amount of time it takes to achieve mode lock significantly increases efficiency. It is not uncommon for current devices to take 150 nanoseconds or more to lock into a mode, and even then it may not be the desired energy-efficient pi mode. Another problem is mode competition, particularly for higher values of axial magnetic field. The excitation of modes other than the pi mode results in excessive noise and a reduction in output power and efficiency. These problems have precluded operation of relativistic magnetrons at high magnetic fields, which are theoretically more energy efficient and capable of producing sustained power output in excess of a gigawatt.

Several methods have been used to prime magnetrons by external means to preferentially excite the device in the desired pi operating mode. This can result in faster oscillation startup, elimination of mode competition, and frequency locking. Radiation priming involves injecting a low level external signal at the same frequency as the desired operating mode. A simpler and less expensive technique is cathode priming. In this technique, the cathode is fabricated by ablating azimuthally periodic emitting regions on the cathode by a KrF laser. (M. C. Jones, V. B. Neculaes, Y. Y. Lau, R. M. Gilgenbach and W. M. White, "Cathode priming of a relativistic magnetron," *Appl. Phys. Lett.* 85, pp. 6332-6334, December 2004.) Another technique is magnetic priming, which uses an azimuthally-periodic axial magnetic field of N/2 periods to rapidly pre-bunch the electrons into the desired N/2 extraction cavities for pure pi-mode operation in an N-cavity magnetron. (M. C. Jones, V. B. Neculaes, W. M. White, Y. Y. Lau, R. M. Gilgenbach, J. W. Luginsland, P. Pengvanich, N. M. Jordan, Y. Hidaka, and H. L. Bosman, "Simulations of magnetic priming in a relativistic magnetron," IEEE Trans. on Elec. Devices, 52, pp. 858-863, May 2005.)

DESCRIPTION OF THE PREFERRED EMBODIMENT

An embodiment of the invention uses a modification of the cathode geometry to prime high-power relativistic magnetrons, thereby causing preferential selection of the pi mode at startup. The cathode geometrical priming reduces mode competition and lock-in time while increasing the power output and efficiency of relativistic magnetrons operated at both low and high axial magnetic fields. The preferential selection of the pi mode at startup is achieved by shaping the cathode to form a DC electric field that has a non-negligible azimuthal component. The azimuthal component aids in the early development of the magnetron instability. The geometry of the shaped field is made to resemble the desired pi mode. With these cathode enhancements the range of parameters over which the relativistic magnetron may operate is greatly increased.

Figure 1:
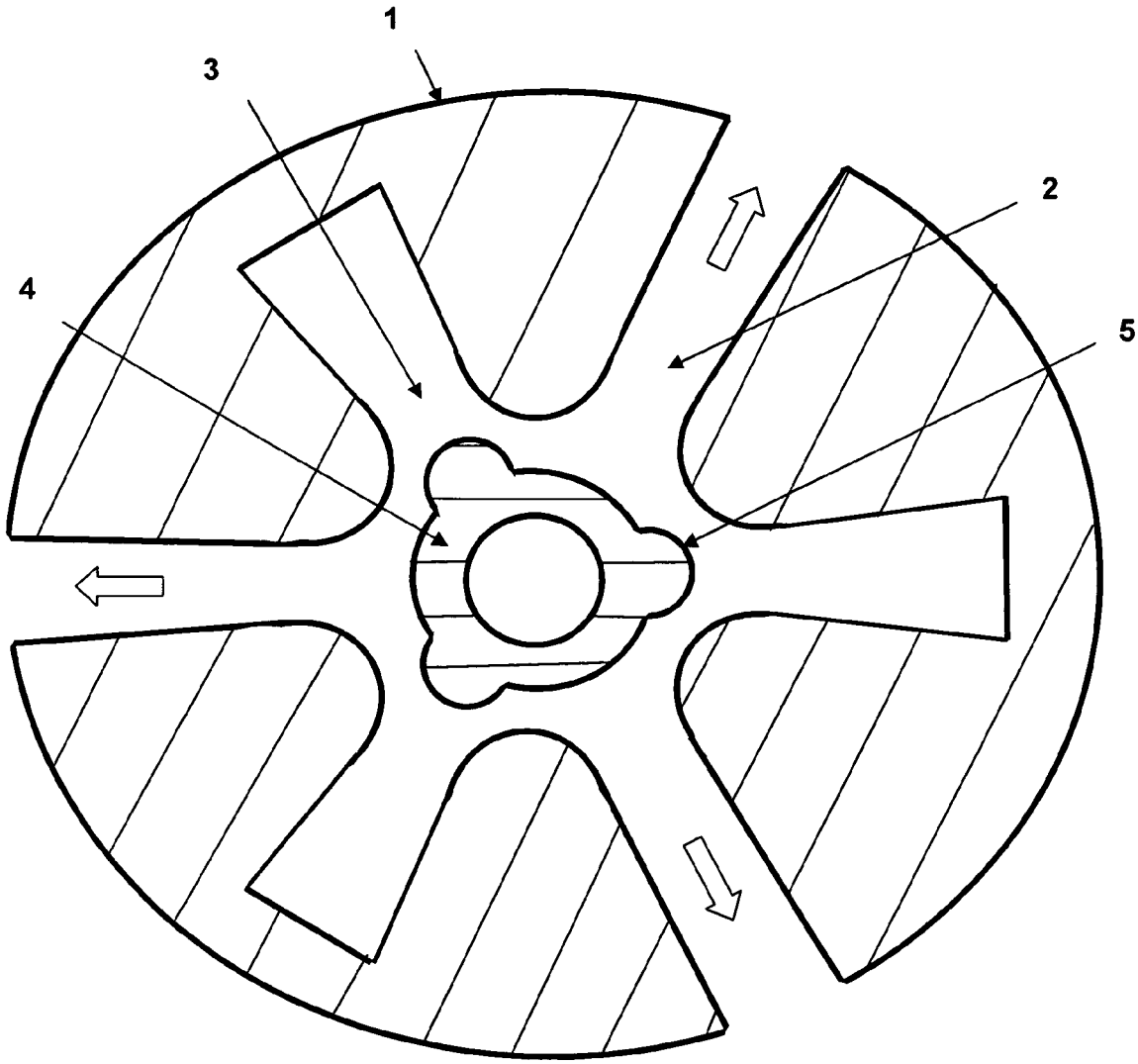
FIG. 1 is a cross-sectional diagram of an A6 relativistic magnetron viewed from the top showing the modified cathode.
Figure 2:
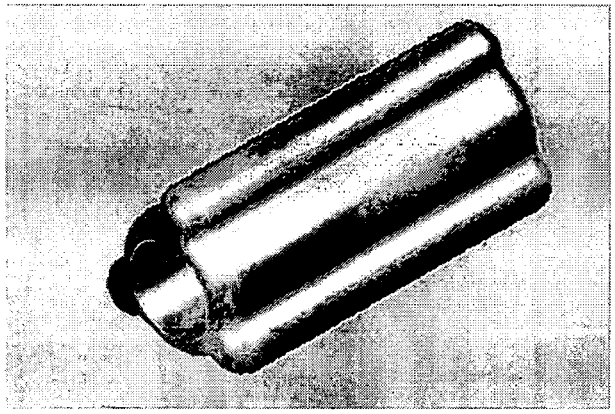
FIG. 2 shows three views of the modified cathode geometry for an A6 magnetron.
Figure 2:
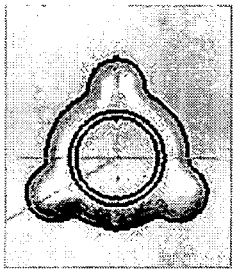
Figure 2:
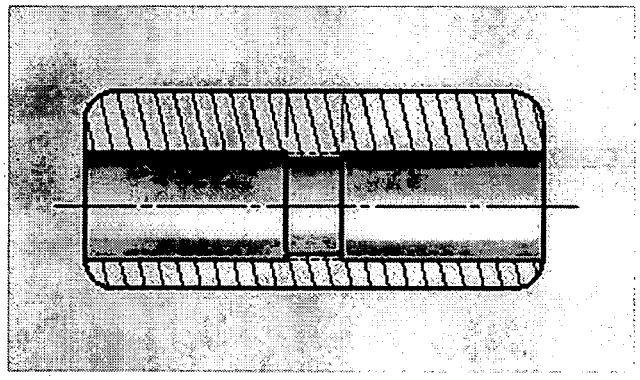

FIG. 1 is an axial top-down view of an A6 relativistic magnetron, here used as an example. The A6 has six cavities, three extraction cavities and three non-extraction cavities. The outer region is the anode 1, also known as the slow wave structure. Alternating cavities 2 in the slow wave structure 1 extract radiation from the interaction region 3. The inner region contains the modified cathode 4. The cathode has a basic cylindrical shape with three half-cylinder protrusions 5 extending outward from the basic cathode cylindrical structure. The central axis of each cylindrical protrusion lies approximately on the radial surface of the main cathode. The cylindrical protrusions are spaced 120 degrees apart and have a radius of approximately 40 percent of the basic cathode cylindrical radius. FIG. 2 shows three perspective views of the cathode as designed for the A6 magnetron. In general, a relativistic magnetron could have N extraction cavities and N non-extraction cavities, in which case there would be N cylindrical protrusions attached to the main cathode and spaced 360/N degrees apart.

As shown in FIG. 1, the relativistic magnetron with a geometrically modified cathode has its axis aligned along the center of the slow wave structure 1 and the cylindrical protrusions 5 aligned with the non-extraction cavities 3. The cylindrical protrusions are part of the cathode, not mere attachments, and as such, are made of the same material as the cathode. The A K gap 3, i.e., the distance between the cathode (K) surface and the slow wave structure (A-anode), is usually on the order of the cathode radius. The nominal radius of the cylindrical protrusions is enough to insure sufficient azimuthal electric field to preferentially select the pi mode at startup.

Figure 3:
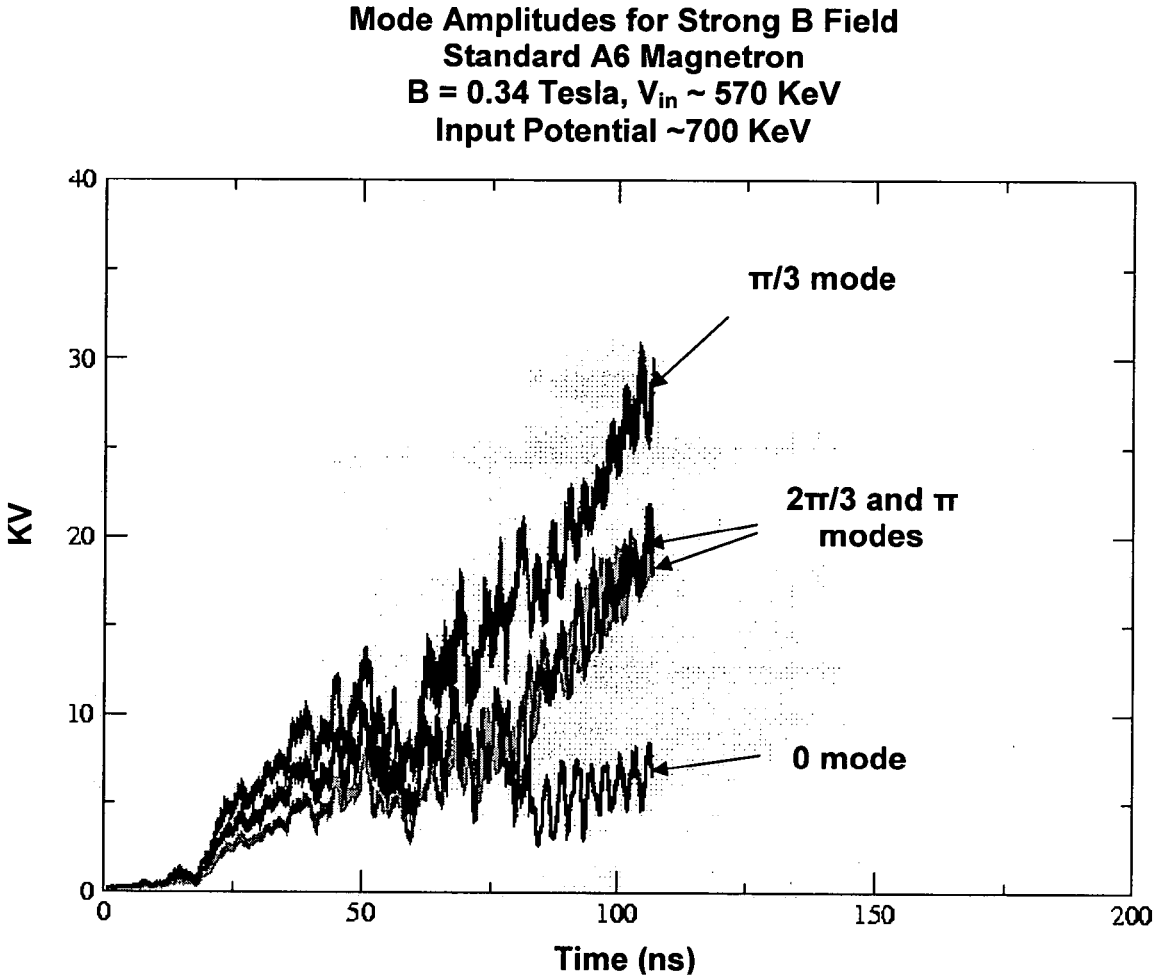
FIG. 3 is a 3-D particle-in-cell simulation that shows the mode amplitudes for a standard A6 magnetron in a high axial magnetic field.
Figure 4:
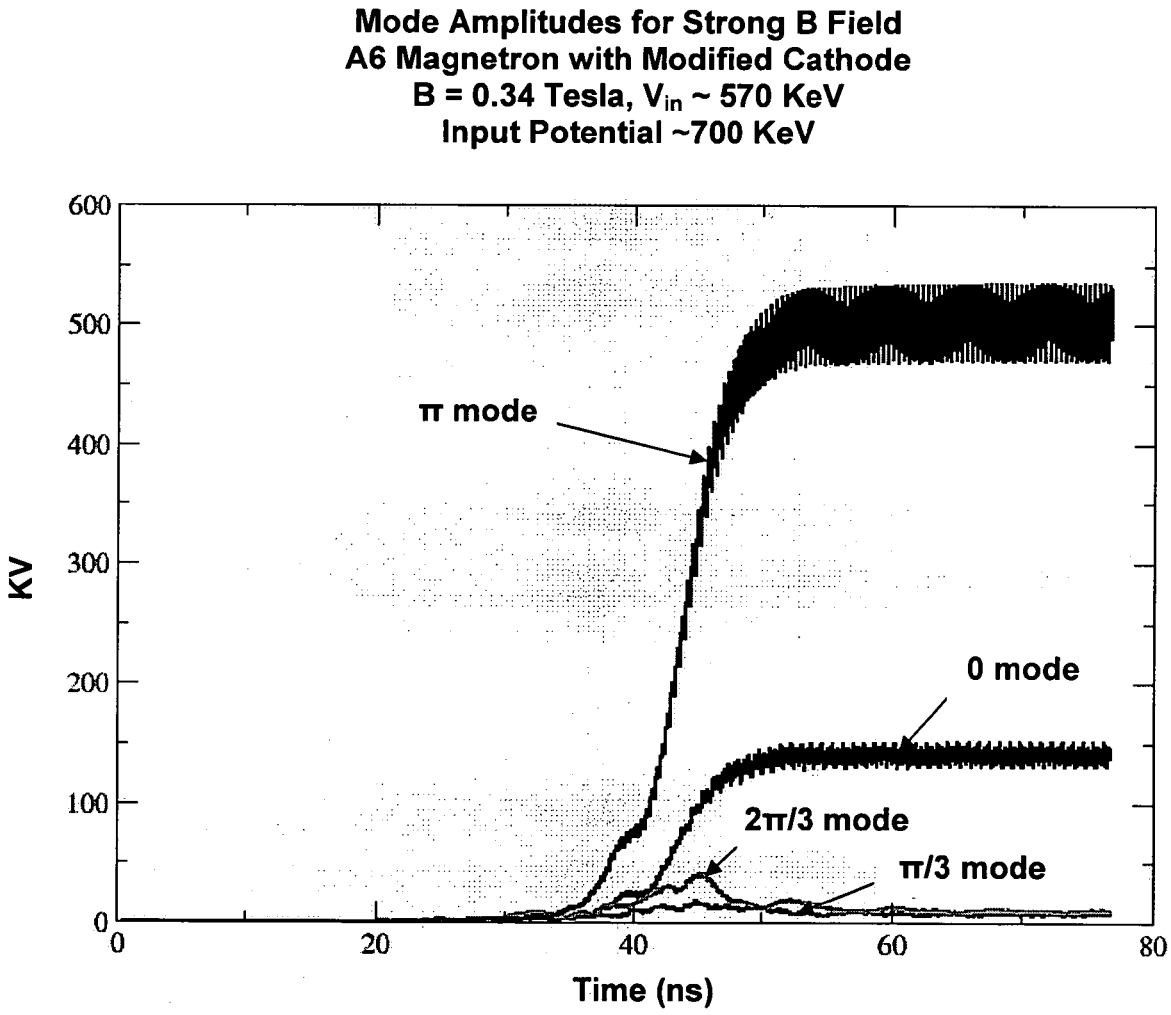
FIG. 4 is a 3-D particle-in-cell simulation that shows the mode amplitudes for an A6 magnetron with the modified cathode in a high axial magnetic field.
Figure 5:
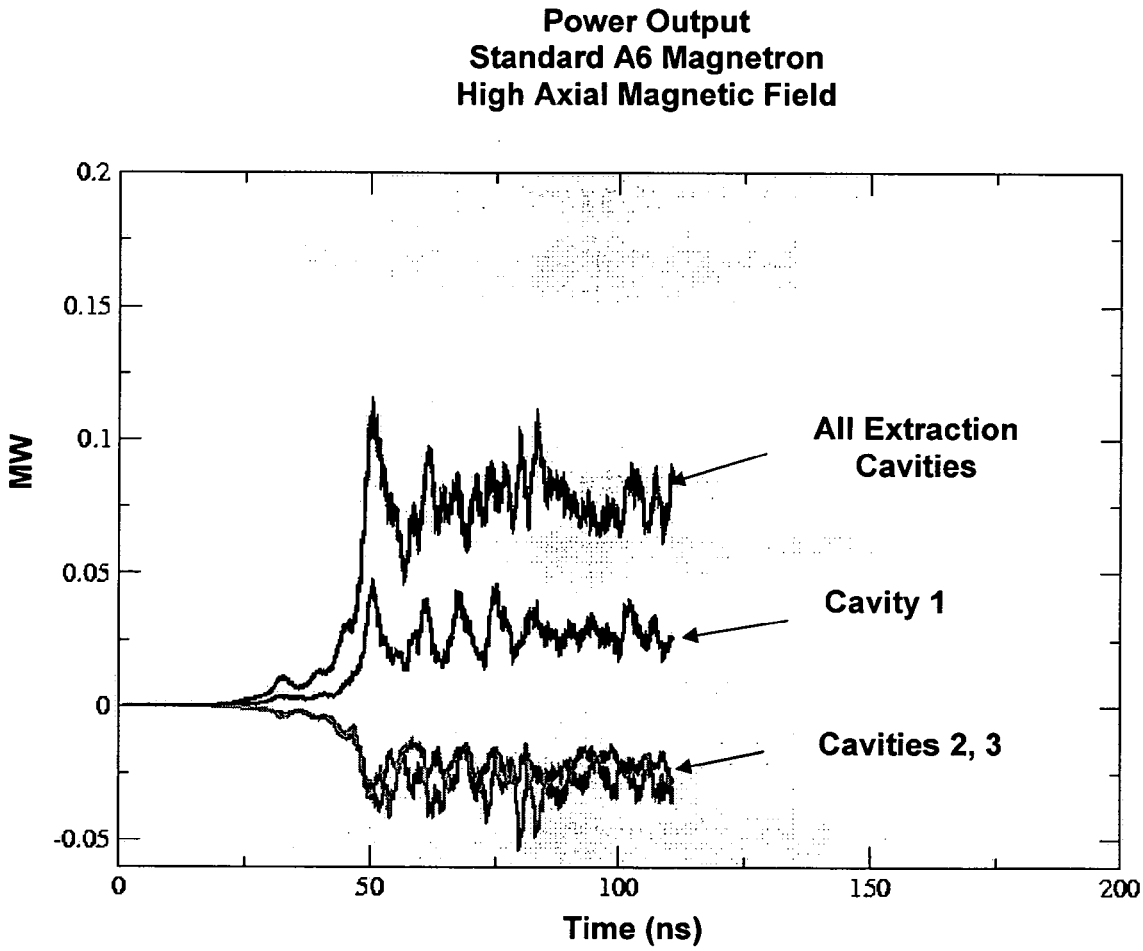
FIG. 5 is a plot of the power output for a standard A6 magnetron in a high axial magnetic field.
Figure 6:
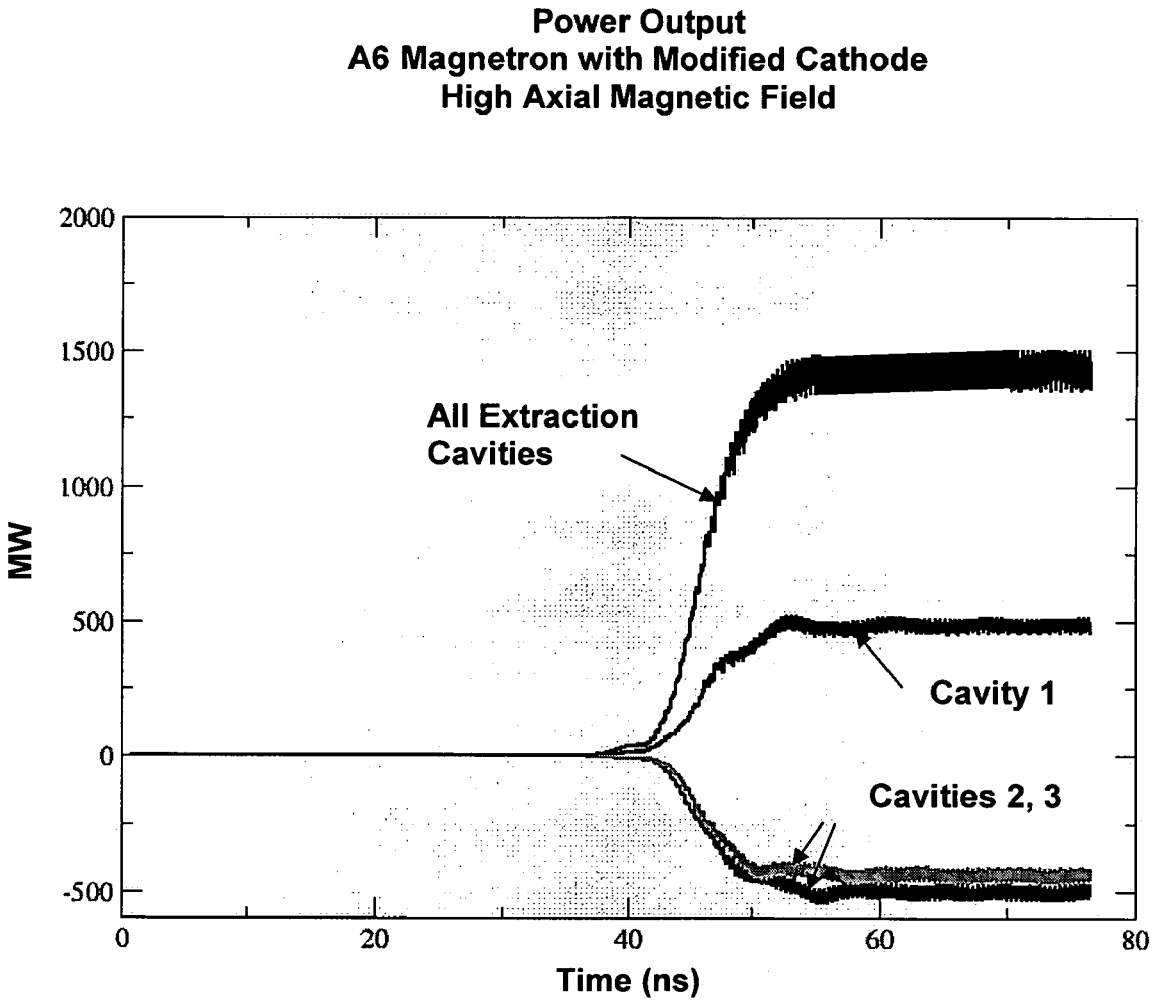
FIG. 6 is a plot of the power output for an A6 magnetron with the modified cathode in a high axial magnetic field.

FIGS. 3-6 plot various parameters derived from a 3-D particle-in-cell simulation for an A6 magnetron having a strong axial magnetic field. In FIG. 3 mode amplitudes for a strong B field are plotted using standard A6 magnetron. In this plot B=0.34 Tesla, $V_{in}$ is approximately 570 KeV, and the input potential is approximately 700 KeV. It shows that the desired pi mode is not the dominant mode and that lock-in has not occurred in over 100 nanoseconds. FIG. 4 is a similar simulation showing mode amplitudes for a strong B field for an A6 magnetron incorporating the modified cathode. In this plot B=0.34 Tesla. $V_{in}$ is approximately 570 KeV, and the input potential is approximately 700 KeV. It shows that mode competition is mitigated, the pi mode is dominant, and lock-in is accomplished in about 40 nanoseconds. The power output of the standard A6 under these conditions is only about 0.75 megawatts as shown in FIG. 5. FIG. 5 is a plot of the power output for a standard A6 magnetron in a high axial magnetic field. In contrast, the power output using the modified cathode is approximately 1.4 gigawatts (FIG. 6). FIG. 6 is a plot of the power output for an A6 magnetron with the modified cathode in a high axial magnetic field.

Figure 7:
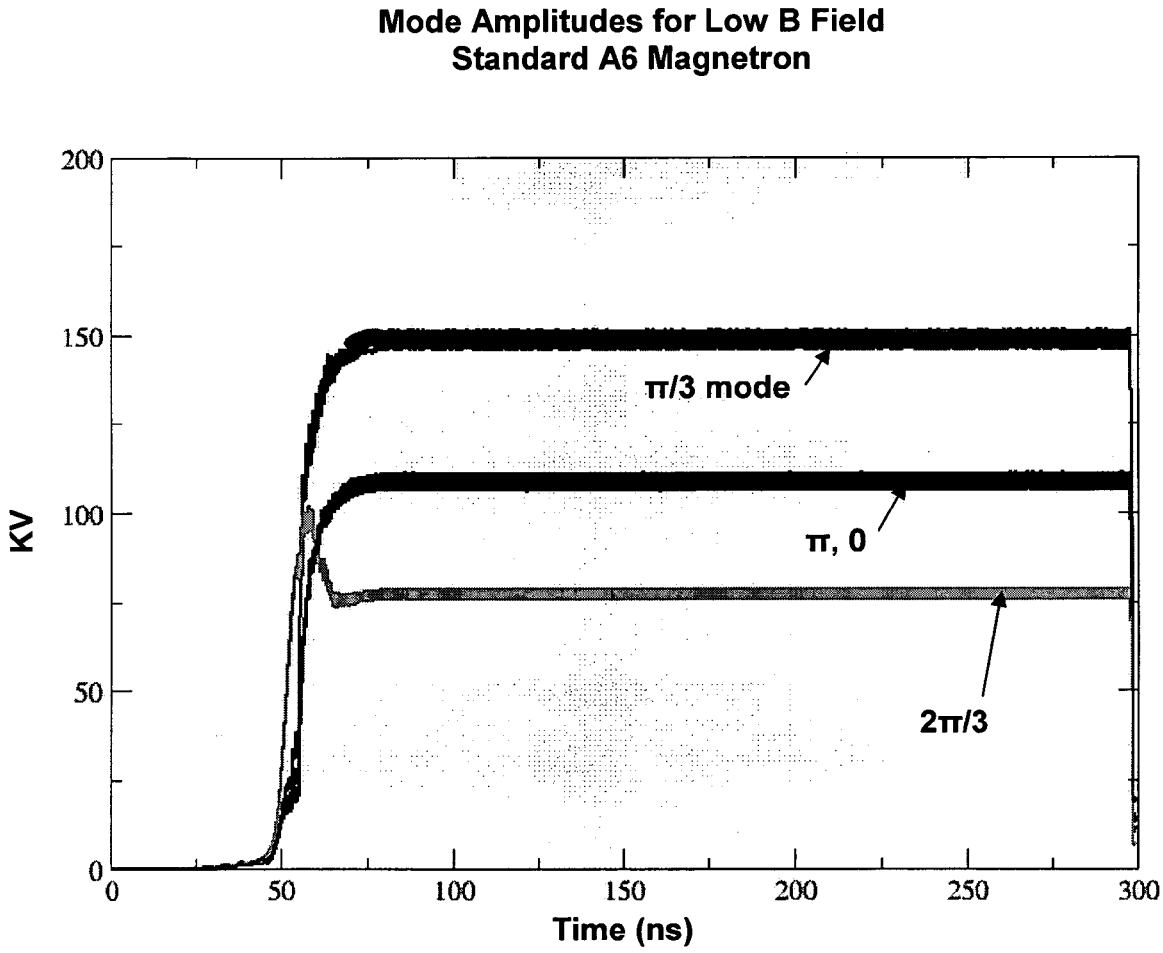
FIG. 7 is a simulation that shows the mode amplitudes for a standard A6 magnetron in a low axial magnetic field.
Figure 8:
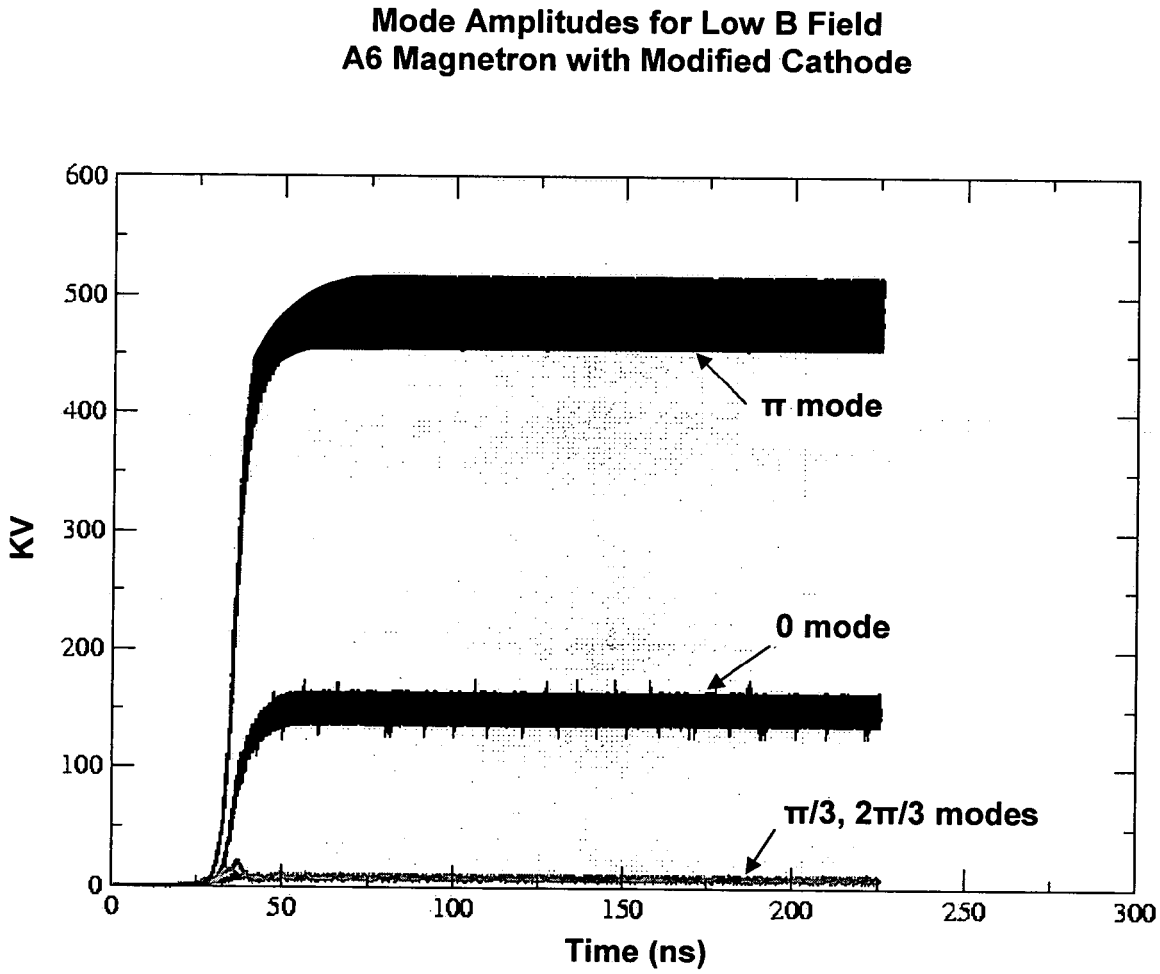
FIG. 8 is a simulation that shows the mode amplitudes for an A6 magnetron with the modified cathode in a low axial magnetic field.
Figure 9:
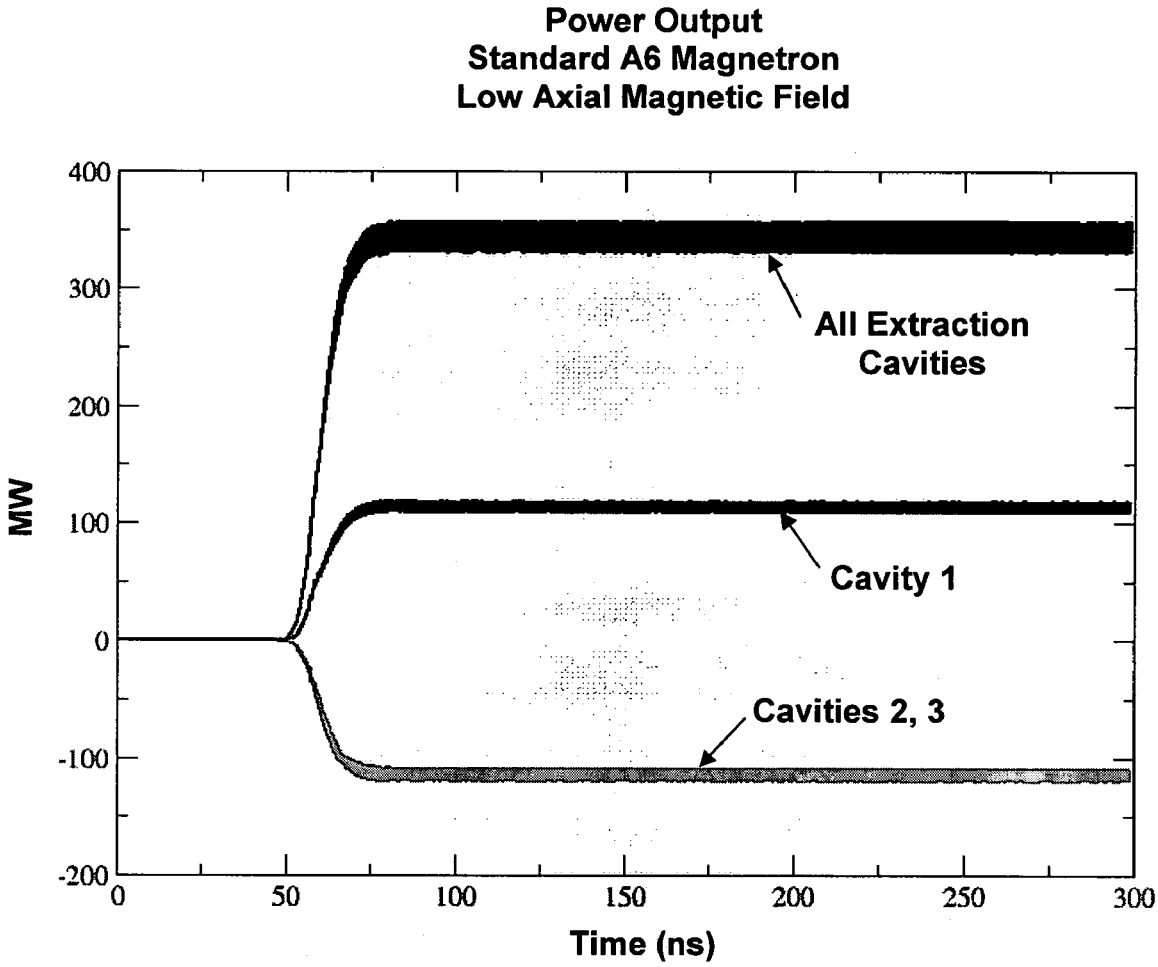
FIG. 9 is a plot of the power output for a standard A6 magnetron in a low axial magnetic field.
Figure 10:
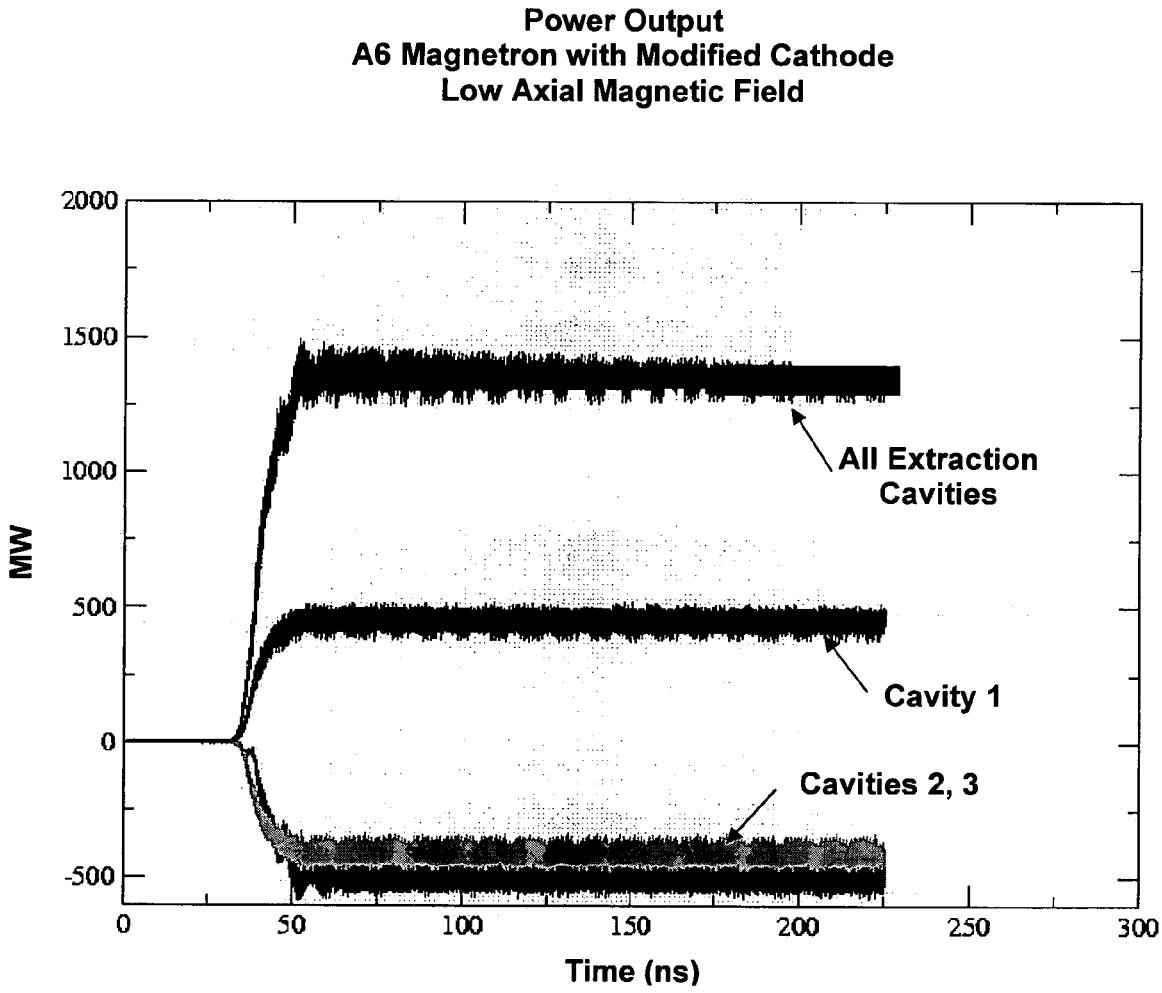
FIG. 10 is a plot of the power output for an A6 magnetron with the modified cathode in a low axial magnetic field.

FIGS. 7-10 show similar mode amplitude simulations for a lower axial magnetic field (B=0.28 Tesla). The standard cathode configuration functions at lower magnetic fields, but the power output is substantially below that obtained using the modified cathode. In FIG. 7 the mode amplitudes for the standard A6 show that the pi mode is not dominant and lock-in occurs at about 70 nanoseconds. FIG. 8 is a plot of mode amplitudes for a lower axial magnetic field using the modified cathode. It shows that mode competition is mitigated, the pi mode is dominant, and lock-in occurs at about 50 nanoseconds. In FIG. 9 the standard A6 output power for a low axial magnetic field is about 350 megawatts while the modified cathode A6 has an output power of about 1.3 gigawatts (FIG. 10). FIG. 10 is a plot of the power output for an A6 magnetron with the modified cathode in a low axial magnetic field.

Figure 11:
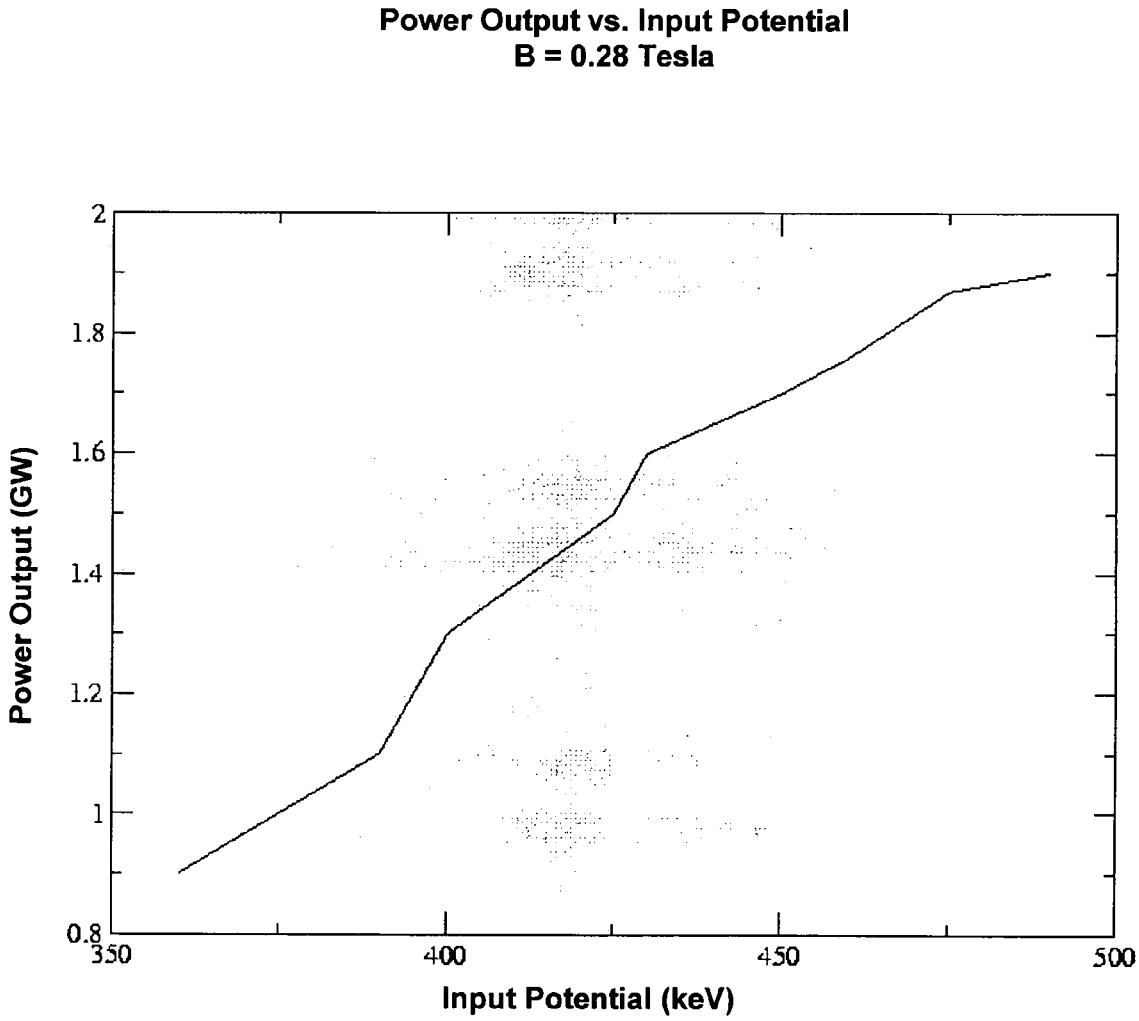
FIG. 11 is a plot of the power output vs. input potential for a low axial magnetic field.
Figure 12:
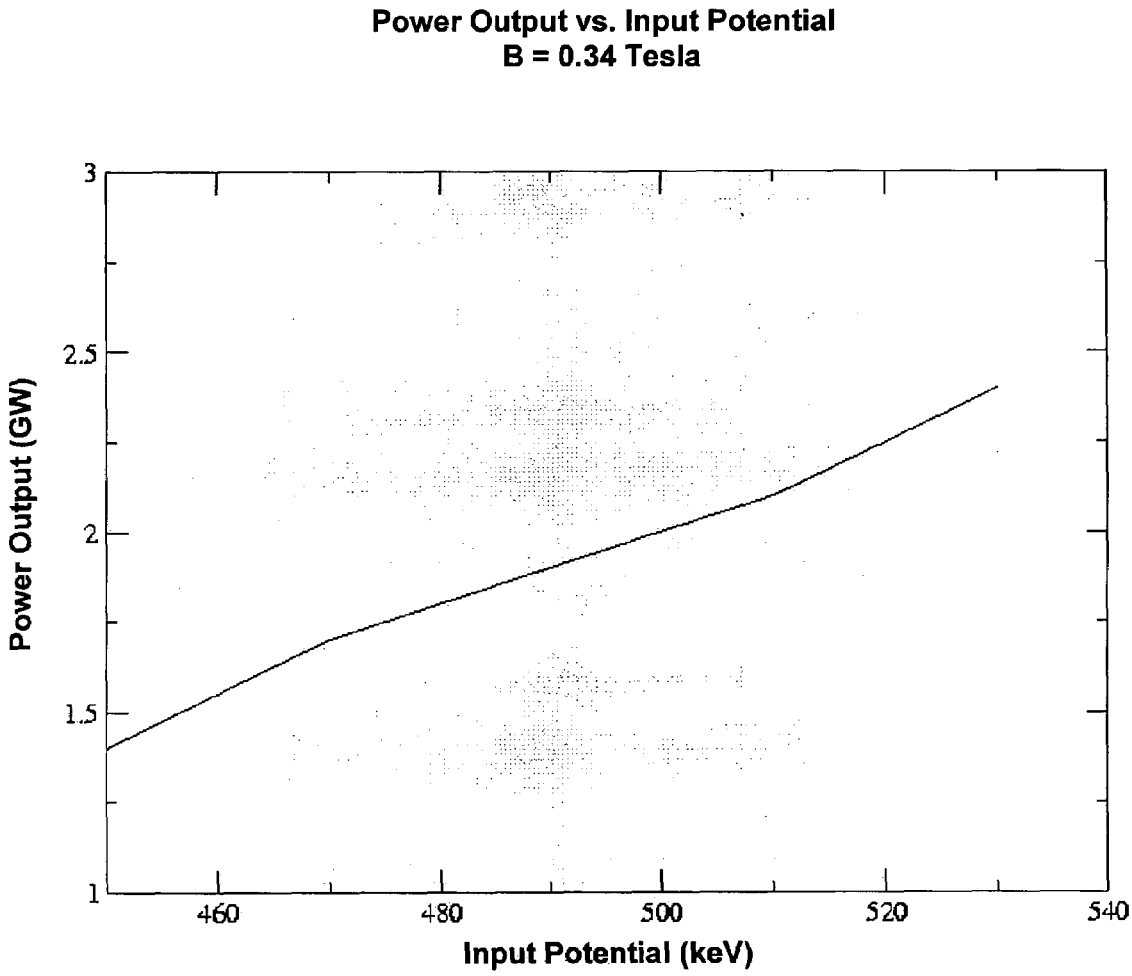
FIG. 12 is a plot of the power output vs. input potential for a high axial magnetic field.

FIGS. 11 and 12 show the theoretical power output for the low and high axial magnetic fields, respectively, vs. the input potential. Well over a gigawatt of output power can be extracted.

The invention claimed is:

1. A relativistic magnetron having N extraction cavities and N non-extraction cavities separating a modified cylindrical cathode from an anode, said cathode being modified from a basic cylindrical shape by N cylindrical protrusions extending outward from the basic cylindrical shape such that a central axis of each cylindrical protrusion lies approximately on the radial surface of the basic cylindrical shape, wherein said cylindrical protrusions are spaced 360/N degrees apart, have a radius of approximately 40 percent of the basic cathode cylindrical radius, and are aligned with the non-extraction cavities.

* * * * *